United States Patent [19]

Hundertmark

[11] Patent Number: 4,490,120

[45] Date of Patent: Dec. 25, 1984

[54] HYDRAULIC TRIM-TILT SYSTEM

[75] Inventor: James M. Hundertmark, Fond du Lac, Wis.

[73] Assignee: Brunswick Corporation, Skokie, Ill.

[21] Appl. No.: 450,832

[22] Filed: Dec. 20, 1982

[51] Int. Cl.[3] ..... F15B 15/22

[52] U.S. Cl. ..... 440/61; 440/53; 91/401; 91/420

[58] Field of Search ..... 440/52, 53, 56, 61, 440/63; 91/401, 420, 445, 437–439, 468, 422; 92/13.51; 248/642; 114/150; 244/78, 226; 60/473, 476; 137/106

[56] References Cited

U.S. PATENT DOCUMENTS

| | | | |
|---|---|---|---|
| 2,630,830 | 3/1953 | Meddock | 91/401 |
| 3,799,104 | 3/1974 | Kurling | 440/61 |
| 3,842,789 | 10/1974 | Bergstedt | 440/61 |
| 3,885,517 | 5/1975 | Borst | 440/61 |
| 4,052,952 | 10/1977 | Hale | 440/52 |
| 4,096,820 | 6/1978 | Hall | 440/61 |
| 4,391,592 | 7/1983 | Hundertmark | 440/61 |

*Primary Examiner*—Trygve M. Blix
*Assistant Examiner*—Patrick W. Young
*Attorney, Agent, or Firm*—O. T. Sessions

[57] ABSTRACT

A hydraulic system for trimming and tilting an outboard propulsion unit (10) includes both trim piston-cylinder units (22, 23) and a trim-tilt piston-cylinder unit (17). The flow of hydraulic fluid from the reversible pump (49) is controlled by a spool valve (26). A pressure relief valve (71) is mounted in the spool (50) to maintain pressure on one side of the spool (50) when the pump (49) is turned off to rapidly close the return valve (56) and prevent further movement of the piston-cylinder units.

8 Claims, 2 Drawing Figures

HYDRAULIC TRIM-TILT SYSTEM

RELATED APPLICATION

This application is related to allowed patent application Ser. No. 06/191,733 filed on Sept. 29, 1982 by the present inventor now U.S. Pat. No. 4,391,592.

TECHNICAL FIELD

This invention relates to the control of hydraulic systems and particularly to hydraulic devices for trimming and tilting outboard propulsion units.

BACKGROUND ART

The hydraulic trim-tilt system disclosed in allowed U.S. patent application Ser. No. 06/191,733 by the present inventor provides a trim-tilt system for outboard propulsion units which uses a pilot valve in the trim piston to provide a different operating pressure for the tilt and trim ranges of operation. In that system it was observed by the inventor that when trimming the propulsion unit in, i.e., downward, the propulsion unit would occasionally continue to move in after the pump was stopped. The continuing movement thus resulted in imprecise trim settings when trimming in, particularly when the unit was lightly loaded as when the drive unit was operating at low power settings or idling.

Another hydraulic trim-tilt system using a shuttle valve to control flow from a pump to hydraulic cylinders is disclosed in U.S. Pat. No. 3,885,517 to Borst, et al.

DISCLOSURE OF THE INVENTION

The present invention provides a hydraulic system for tilting and precisely trimming an outboard propulsion unit which is pivotally mounted on a support member for mounting on a boat. The hydraulic system includes a trim-tilt piston-cylinder unit connected between the propulsion unit and support member for trimming and tilting the propulsion unit. A shuttle valve connects a pump to operate the trim-tilt piston-cylinder unit when the pump is operating and includes a shuttle piston mounted in a valve cylinder. The shuttle valve includs first and second passageways on a first side of the shuttle piston to connect the discharge side of the pump to one side of the trim-tilt piston-cylinder unit when the pump is operating. Third and fourth passageways are provided on the second side of the shuttle piston to connect the discharge side of the pump to the other side of the trim-tilt piston-cylinder unit. A first pilot operated one-way valve included in the fourth passageway between the shuttle valve and the piston-cylinder unit to normally prevent flow from the piston-cylinder unit to the valve cylinder. The pilot valve is opened by a pilot member on the shuttle piston when the pump is operating, thereby allowing return flow from the piston-cylinder unit to the inlet of the pump. The shuttle valve piston also acts with a piston controlled port in the valve body to provide a relief passage from the second side of the shuttle piston when the pilot valve is opened by the pilot member of the shuttle piston. To assure that the pilot member allows the pilot operated valve to rapidly close when the pump is stopped, a biasing means is provided to bias the shuttle piston away from the pilot valve.

The biasing means can take the form of a pressure relief valve mounted in the relief passage to maintain a predetermined pressure level in the valve cylinder on the side of the shuttle piston to bias the shuttle piston away from the pilot valve. Preferably the shuttle valve piston includes a passageway forming a portion of the relief passage and, in the preferred embodiment, the relief valve is mounted in the valve piston.

BEST MODE FOR CARRYING OUT THE INVENTION

Figure 1:
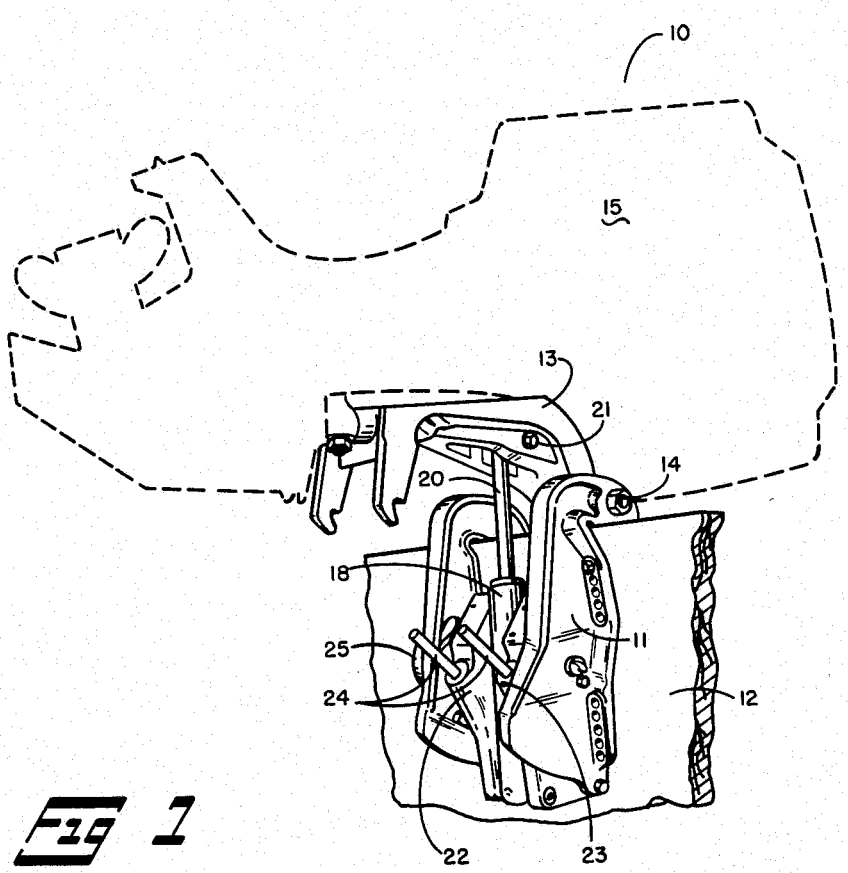
FIG. 1 is a perspective view showing an outboard motor incorporating features of the invention.

The outboard motor 10 shown in FIG. 1 includes a transom bracket 11 for attachment to the transom 12 of a boat. A swivel bracket 13, pivotally mounted on the transom bracket 11 by a tilt pin 14, supports the outboard drive unit 15 and allows tilting movement about the axis provided by the tilt pin 14. The outboard drive unit 15 is pivotally mounted on the swivel bracket 13 to provide steering control about a generally vertical steering axis.

A hydraulic trim-tilt system 16 is provided for trimming and tilting the outboard drive unit 15 and for absorbing shock in the event of collision with an underwater obstacle. The hydraulic system 16 includes a trim-tilt hydraulic piston-cylinder unit 17 having its cylinder 18 pivotally connected at its lower end to the transom bracket 11 by a pin 17 and having its piston rod 20 pivotally connected to the swivel bracket 13 by another pin 21. Two hydraulic trim piston-cylinder units 22 and 23 are mounted on the transom bracker 11, one on each side of the trim-tilt unit 17, with their piston rods 24 extending to the rear and upward. An electrically operated reversible hydraulic pump unit 25 is mounted in the transom bracket 11 above one of the trim cylinders 22 and includes a spool valve 26 which is connected to drive the hydraulic cylinders. In the full tilt position shown in FIG. 1 the outboard drive unit 15 is supported solely by the fully extended trim-tilt piston-cylinder unit 17, while over the range of trim positions the drive unit 15 is supported by the two trim piston rods 24 abutting against the swivel bracket 13 as well as the trim-tilt unit 17.

Figure 2:
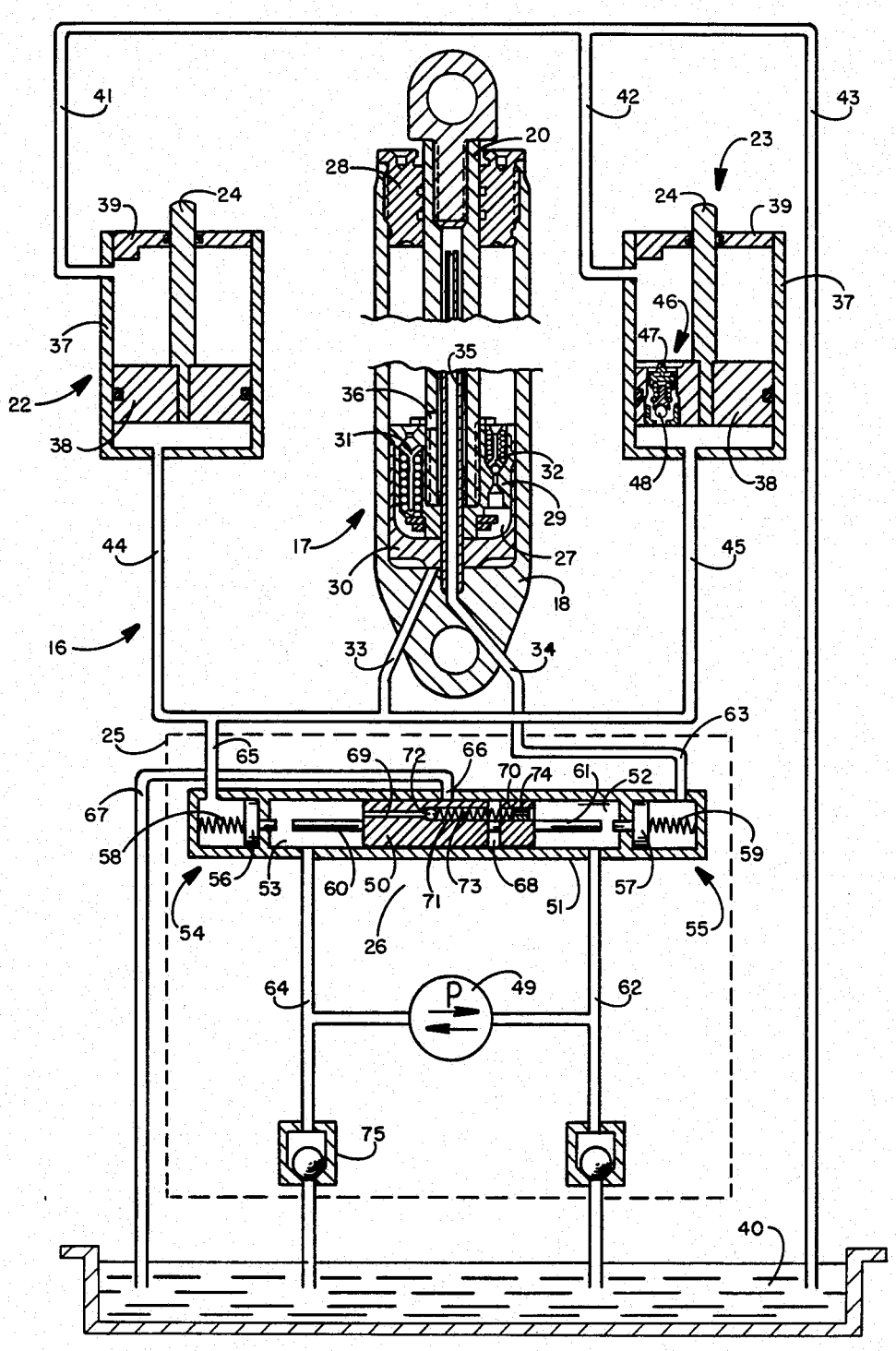
FIG. 2 is a schematic view of the hydraulic system incorporated in the outboard motor of FIG. 1.

The trim-tilt piston-cylinder unit 17 shown in FIG. 2 is similar to those shown in FIGS. 9, 10, and 11 of U.S. Pat. No. 4,052,952. The unit 17 includes a cylinder 18 which receives a piston assembly 27, a cylinder end cap 28 and a piston rod 20 extending through the cylinder end cap 28. The piston assembly includes a shock piston 29 attached to the piston rod 20 and a floating trim piston 30. The shock piston 29 includes a spring loaded ball shock valve 31 to allow flow through the shock piston 29 in response to the shock loading on the piston rod 20 should the lower drive unit strike an object underwater. Thus under a shock load the drive unit 15 will tilt up, extending the piston rod 20, and pulling the shock piston 29 away from the trim piston 30. A spring loaded ball return valve 32 in the shock piston 29 allows the outboard drive unit 15 to gently return to its lower position when the shock load has passed. A first inlet 33 is provided to supply hydraulic fluid to the bottom side of the piston assembly 27 and a second 34 is provided to supply hydraulic fluid to the top side of the piston assembly 27. The second inlet 34 is connected to the top side of the piston assembly 27 by a tube 35 telescoped into the tubular piston rod 20 and a hole 36 in the side of the piston rod 20 near the top of the shock piston 29.

The trim piston-cylinder assemblies 22 and 23 include closed cylinders 37 mounted in the transom bracket 11, pistons 38 mounted in the cylinders 37, and piston rods 24 extending through the cylinder caps 39. The cylinders 37 are connected above the pistons 38 to the sump 40 by passageways 40, 41 and 42. Below the trim pistons 38 the cylinders 37 are connected by passageways 44 and 45 to the pump unit 25. One of the trim pistons 38 include a pilot operated check valve 46 which acts to limit the maximum pressure below the pistons 38 in both the trim the trim-tilt units 22, 23 and 17 when the trim pistons 38 have reached the top of their stroke. The pilot operated check valve 46 is like the one disclosed in patent application Ser. No. 06/191,733 and acts to normally close the passageway through the trim piston 38. When the trim piston 38 reaches the top of its stroke the valve stem 47 is depressed by contact with the cylinder cap, thus freeing the valve to operate as a pressure relief valve when pressure below the piston 38 is high enough to open the spring loaded ball valve 48.

The hydraulic system is powered by a reversible electric motor driven gear pump 49 connected to the trim cylinders and the trim-tilt cylinder by a shuttle valve 26. A reservoir or sump 40 assures an adequate supply of hydraulic fluid to the system. The shuttle valve 26 operates in response to forward or reverse operation of the pump 49 to direct hydraulic fluid under pressure to extend or retract the cylinders 17, 22 and 23.

The shuttle valve 26 inclues a valve spool 50 mounted in a closed tubular valve housing 51, forming a first chamber 52 on the right side of the spool 50 and a second 53 on the left. The valve spool 50 is axially movable in response to fluid pressure in the valve chambers 52 and 53 to perform its valving functions. First and second pilot operated one-way valves 54 and 55 are provided at each end of the valve housing 51 to normally prevent flow into the valve chambers 52 and 53 and allow flow out of the chambers 52 and 53. The pilot operated valves 54 and 55 include valve members 56 and 57 biased to close the flow control ports by springs 58 and 59. Oppositely extending plungers 60 and 61 on each end of the valve spool 50 serve to open the pilot operated valves 54 and 55 when the valve spool 50 is shifted to the left or right to allow flow out of the valve chambers 52 and 53. The first valve chamber 52 is connected to one side of the pump 49 by a first passageway 62. A second passageway 63 is connected through the pilot operated valve 55 to the top of the trim-tilt cylinder 17 by way of the tube telescoped 35 in the piston rod 20. The second valve chamber 53 is connected by a third passageway 64 to the other side of the pump 49. A fourth passageway 65 connects the second valve chamber 53 through the pilot operated valve 54 to the bottom of both of the trim cylinders 22 and 23 and the trim-tilt cylinder 17. The top of the trim cylinders 22 and 23 are connected by another passageway 43 directly to the reservoir 40.

A center port 66 in the valve housing 51 is connected by a relief passageway 67 to the reservoir 40. The center port 66 is controlled by the movement of the valve spool 50 and is closed by the spool 50 except when the spool 50 has shifted to the left to open the pilot operated valve 54. Then the port 66 is aligned with a recessed portion of the spool 68. The spool 50 includes axially aligned passageways 69 and 70 on both sides of the recess 68 to provide communication between the recess 68 and the valve chambers 52 and 53. A pressure relief valve 71 is formed in the passageway 69 on the left hand side of the spool 50 by a valve seat formed in the passageway 69 and a ball valve member 72 mounted in the passageway.

A coil spring 73 is housed in the passageways 69 and 70 to bias the ball valve member 72 against the valve seat to close the passageway 69 and open when the pressure in the second valve chamber 53 exceeds a predetermined level, thus forming the pressure relief valve 71. The spring 73 is held in place by an orifice member 74 pressed into the passageway 70 on the right hand side of the spool 50. A small orifice is provided through the orifice member 74 to allow the pressure in the first chamber 52 to bleed down when the pump 49 is turned off. The combination of the increased pressure in the second chamber 53 provided by the pressure relief valve 71 and the pressure relief passage 69 provided by the orifice provides a differential pressure across the spool 50 when the pump 49 is turned off after operating in the direction to pressurize the first valve chamber 53. The pressure differential across the spool 50 causes the spool 50 to rapidly move to the right when the pump 49 is turned off, thus allowing the pilot operated valve 54 to close and prevent further motion of the hydraulic piston-cylinder units 17, 22 and 23.

OPERATION

In operation, with the trim and trim-tilt pistons 38 and 27 in their lower positions the outboard propulsion unit 15 may be trimmed out, i.e., up, by turning on the electric motor driven pump 49 to supply pressure to the second chamber 53 in the spool valve 26. The pressure of the fluid will then open the spring biased valve member 56 to allow flow to supply hydraulic fluid to the trim-tilt and trim cylinders 17, 22 and 22 by means of the fluid passages 33, 44, 45 and 65, thereby raising the pistons. Simultaneously the pressure will drive the spool valve member 50 to the right and the plunger 61 will open the valve member 57 port to allow the hydraulic fluid above the trim-tilt piston 27 to return to the suction side of the pump 49. The hydraulic fluid above the trim pistons 38 will return to the sump 40 by way of the fluid passageways 41, 42 and 43 and the additional fluid required by the pump 49 will be made up by upward flow from the sump 40 through the ball check valve 75.

When the trim pistons 38 have reached the top of their stroke the pilot operated check valve 46 will open, thereby limiting the maximum pressure of the fluid supplied to the trim-tilt piston-cylinder unit 17. With a properly sized spring in the pilot operated check valve 46 the pressure in the system will be reduced sufficiently to prevent the trim-tilt piston 27 from overcoming the thrust of the outboard propulsion unit 15, thereby preventing tilting of the outboard propulsion unit 15 when the propeller is producing forward thrust.

To tilt the drive unit down, the electric motor driven pump 49 is reversed to supply fluid to the right side of the spool valve member 50, thereby opening the right valve member 56 and supplying fluid by the passage 63 to the top of the trim-tilt cylinder 17 and driving the trim-tilt piston 27 downward. The pressure on the right will drive the spool valve member 50 to the left, thereby opening the left valve member 56 to the pump inlet. At the same time the recessed portion 68 of the spool valve piston 50 will align with the center port 66 in the valve housing 51 to connect the recessed portion of the spool 68 with the reservoir 40 by way of the relief passageway 67. Thus when the trim-tilt piston 27 begins to drive the trim pistons 38 downward, the excess hydraulic fluid will flow to the second valve chamber 53 and, upon building up to the predetermined pressure level, open the pressure relief valve 71 and discharge to the reservoir 40 while maintaining the predetermined pressure level on the left side of the spool 50. The excess hydraulic fluid will continue to discharge through the relief passageway 67 until the pump 49 is turned off.

When the pump 49 is turned off, the orifice in orifice member 74 allows fluid from the first valve chamber 52 on the discharge side of the pump 49 to relieve the pressure on the right side of the spool 50. Simultaneously the relief valve 71 will close to maintain pressure on the left side of the spool 50. The resulting differential pressure across the spool 50 will rapidly move the spool to the right, allowing the pilot operated valve 54 to close and prevent further movement of the hydraulic piston-cylinder units.

I claim:

1. A hydraulic system for trimming and tilting an outboard propulsion unit pivotally mounted on a support member for mounting on a boat, said hydraulic system comprising:

(A) a trim-tilt hydraulic piston-cylinder unit including a trim-tilt cylinder having closed ends, said cylinder pivotally connected to one of said propulsion unit and said support member and including a trim-tilt piston mounted in said trim-tilt cylinder and a trim tilt piston rod attached to said piston, said piston rod attached to the other of said propulsion unit and said support member;

(B) a pump having an inlet and an outlet;

(C) a reservoir for hydraulic fluid; and (D) a shuttle valve for connecting said outlet of said pump to said trim-tilt cylinder on one side of said trim-tilt piston and said inlet of said pump to said trim-tilt cylinder on the other side of said trim-tilt piston when said pump is operating, said shuttle valve including:

(1) a valve body including a closed valve cylinder and a piston controlled valve port;

(2) a valve spool including a pilot member mounted for reciprocation in said valve cylinder and forming a first chamber on one side of said valve spool and a second chamber on the other side of said valve spool, said first chamber connected by a first passageway to said outlet of said pump and by a second passageway to said trim-tilt cylinder on one side of said trim-tilt piston, said second chamber connected by a third passageway of said inlet of said pump and by a fourth passageway to said trim-tilt cylinder on the other side of said trim-tilt piston;

(3) a first pilot operated one-way valve in said fourth passageway, said first one-way valve normally preventing from from said trim-tilt cylinder to said second chamber and opened by said pilot member when said pump is operating to allow return flow from said trim-tilt piston cylinder unit to said inlet of said pump, said valve spool acting with said piston controlled port to provide a relief passage from said second chamber to said reservoir when said first one-way valve is opened by said pilot member; and (4) a biasing means to assure that said pilot member allows said pilot operated valve to rapidly close when said pump is stopped.

2. The hydraulic system defined in claim 1 wherein said biasing means comprises a pressure relief means mounted in said relief passage to maintain a predetermined pressure level in said second chamber while said pump is operating.

3. The hydraulic system defined in claim 2 wherein said valve spool includes a passageway forming a portion of said relief passage.

4. The hydraulic system defined in claim 3 wherein said pressure relief means is mounted in said valve spool.

5. The hydraulic system defined in claim 4 wherein said valve spool includes a passageway for connecting said first chamber to said relief passage when said first one-way valve is opened by said pilot member.

6. The hydraulic system defined in claim 5 wherein said pressure relief means comprises a spring biased ball valve.

7. The hydraulic system defined in claim 1 further comprising:

(E) a trim hydraulic piston-cylinder unit connected to one of said propulsion unit and said support member and having an extensible port engaging the other of said propulsion unit and said support member, said trim piston-cylinder units connected to said second chamber of said shuttle valve by said fourth passageway.

8. The hydraulic system defined in claim 7 wherein said trim piston-cylinder unit includes a trim cylinder having closed ends and a trim piston mounted in said trim cylinder and attached to said extensible part, said fourth passageway connected to said trim cylinder on one side of said trim, and further including a fifth passageway connected between said reservoir and said trim cylinder on the other side of said trim piston.

* * * * *